US005960499A

United States Patent [19]

Gehrlein

[11] Patent Number: 5,960,499

[45] Date of Patent: Oct. 5, 1999

[54] APPARATUS AND PROCESS FOR APPLICATION OF A BATH TO A CONTINUOUS TEXTILE WEB

[75] Inventor: Heiner Gehrlein, Krefeld, Germany

[73] Assignee: Kleinewefers Textilmaschinen GmbH, Krefeld, Germany

[21] Appl. No.: 08/965,509

[22] Filed: Nov. 6, 1997

[30] Foreign Application Priority Data

Nov. 9, 1996 [DE] Germany ..... 196 46 376

[51] Int. Cl.[6] ..... D06B 3/10

[52] U.S. Cl. ..... 8/151; 68/202

[58] Field of Search ..... 8/151, 158, 159; 68/12.02, 12.04, 12.05, 12.21, 200, 202, 205 R, 175, 207, 208

[56] References Cited

U.S. PATENT DOCUMENTS

| | | | |
|---|---|---|---|
| 2,866,254 | 12/1958 | Ball | 68/202 |
| 2,960,963 | 11/1960 | Shelton | 68/175 |
| 3,128,616 | 4/1964 | Giani | 68/175 |
| 3,438,071 | 4/1969 | Clark | 68/175 |
| 3,675,622 | 7/1972 | Griffin | 68/205 R |
| 4,447,924 | 5/1984 | Bolton et al. | 8/151 |
| 4,611,476 | 9/1986 | Fleissner | 68/175 |
| 4,620,338 | 11/1986 | Von Der Eltz et al. | 8/158 |
| 4,777,683 | 10/1988 | Pellerin | 8/158 |
| 4,947,501 | 8/1990 | Koch | 8/151 |
| 5,119,647 | 6/1992 | Godau | 68/175 |
| 5,285,544 | 2/1994 | Weber | 8/158 |
| 5,497,637 | 3/1996 | Fuller et al. | 68/205 R |

FOREIGN PATENT DOCUMENTS

| | | | |
|---|---|---|---|
| 1127226 | 1/1955 | France | 8/151 |
| 2-191763 | 7/1990 | Japan | 68/175 |
| 1190797 | 5/1970 | United Kingdom | 68/205 R |

*Primary Examiner*—Frankie L. Stinson
*Attorney, Agent, or Firm*—Darby & Darby

[57] ABSTRACT

In a device for application of a bath to a continuous textile web, a deflection roller is disposed in a trough. The textile web contacts the deflection roller when passing through the trough. The device permits variations in treatment of the textile web by varying the time that the web is in contact with the bath in the trough. The time that the web is in contact with bath in the trough is determined in part by the filling height of the bath in the trough which is controlled by treatment time adjustment means.

29 Claims, 1 Drawing Sheet

22
29
27
31
23
24
28
30
2
26
34
36
35
37
1
33
32
12
19
2
21
7
22
6
16
14
3
18
20
25
11
15
5
10
h1
8
13
h2
4
9
17

APPARATUS AND PROCESS FOR APPLICATION OF A BATH TO A CONTINUOUS TEXTILE WEB

BACKGROUND OF THE INVENTION

The invention relates to a device for continuous application of a bath to an endless textile web, the device having a trough in which a deflection roller is disposed. The textile web is in contact with the deflection roller as the web passes through the trough. In addition, the invention relates to a process for application of a bath to a continuous textile web, in which process the textile web, while in contact with a deflection roller, is guided through a trough filled with the bath.

When manufacturing or processing continuous textile webs, it is necessary for a bath to be applied to the textile web in some processing steps. The bath is a liquid that contains chemicals. The chemicals are intended to have an effect on the textile web.

In addition to applying the bath by spray systems, it is known in the prior art to dip the textile web into the bath.

When distributing a bath onto a textile, a distinction is made between "penetration distribution," in which the dwell time of the endless textile web in the bath is long enough to allow an exchange between the treatment bath in the trough and a liquid from an earlier process step that is contained in the textile web, and "addition distribution," in which the bath is applied only to the surface of the textile web. In the latter case, the bath does not penetrate into the textile web until a process step of further treatment, such as, for example in a storage and reaction section of the device. Thus, in the latter case, an exchange, of the treatment bath in the trough with a liquid that is already contained in the textile web, does not occur in the trough. Selection of the type of distribution depends on the type of textile web to be treated and also depends on the desired result. In many cases it is desirable for both alternatives to be available. However, having both alternatives available involves difficulties, such as, for example, different devices must be used for each type of distribution, or a single device must undergo a complicated conversion from penetration distribution to addition distribution.

An object of the invention is to allow variable treatment of the continuous textile web.

SUMMARY OF THE INVENTION

The object of the invention is fulfilled in an apparatus for applying a bath to a continuous textile web by providing treatment time adjustment means to control the liquid level in the trough.

With the present design of the device, it is possible to change over from penetration distribution to addition distribution, or vice versa, with no significant modification of the path of the endless textile web and without changing the speed of the web. If penetration distribution is desired, the liquid level of the bath in the trough is increased, so that the dwell time of the textile web in the bath is prolonged. In contrast, if addition distribution is desired, the liquid level in the trough is lowered. Since the path of the textile web through the trough is defined by the deflection roller, lowering of the liquid level results in a correspondingly shorter treatment time. As the bath level in the trough is lowered the textile web dips into the bath later and then leaves it earlier. Accordingly, a shorter treatment time can be achieved while the web travels at the same speed. The only change that is made in using the device is the change in the height of the liquid level in the trough. The change of liquid level in the trough can be accomplished without complicated conversion of the device or other laborious measures.

The textile web advantageously winds around the deflection roller by substantially at least half of the circumference of the deflection roller, and the bath level can be changed by a height corresponding to the winding height of the deflection roller. The winding height is the difference between, on the one hand, the point at which the textile web engages the deflection roller on entering the trough or the point at which the textile web disengages the roller on leaving the trough and, on the other hand, the lowest point of the web in the trough, which generally corresponds to the lowest point of the deflection roller in the trough. If, for example, the textile web winds over a portion of the deflection roller corresponding to half of the circumference of the deflection roller, then the winding height corresponds to the radius of the deflection roller. This arrangement allows the maximum range of variations in treatment times. If the liquid level in the trough is so high that the bath is applied to the textile web as soon as it comes into contact with the roller, the web is subjected to the maximum possible treatment time. In a case where the web is subjected to the maximum possible treatment time, i.e., the liquid level is high, penetration distribution occurs. In contrast, if the liquid level in the trough is lowered so far that only the lower vertex of the deflection roller dips into the liquid or touches the surface of the liquid, then the web is subjected to the minimum possible treatment time, and addition distribution occurs. Between the maximum and minimum treatment time extremes, variables are possible that are produced merely by changing the liquid level in the trough.

The deflection roller is preferably designed as a baffle drum. Such a baffle drum is known, for example, from washing machines. It may also be referred to as a grooved drum. It can preferably be covered with a net or wire mesh, in order to form a cylindrical surface. The mesh covered by a cylindrical surface allows the treatment bath to reach the endless textile web from both sides. This is apparent without further explanation for the side of the textile web that is not in contact with the baffle drum. On the opposite side of the textile web, i.e., the side that is in contact with the baffle drum, the bath contacts the web by entering between the drum and the textile web. Penetration is prevented somewhat by support elements on the baffle drum. However, due to the design of the baffle drum, the bath cannot flow out of the drum without contacting the side of the textile web that is in contact with the drum. In that way acceptable application to the side of the textile web that is in contact with the drum is also obtained.

To further ensure suitable application of bath to both sides of the web, auxiliary bath supply means, such as, for example, spray nozzles, may be disposed on each side of the continuous textile web preferably just before the web enters the trough. Some of the bath supplied by the auxiliary bath supply means is carried into the trough by the web and/or by gravity. Therefore, bath is suitably supplied to the trough and to both sides of the textile web, so that both sides are evenly treated with fresh bath.

The trough advantageously has an essentially semicircular cross section, at least below the deflection roller, and closely surrounds the deflection roller, thereby forming a gap. This configuration minimizes the liquid content of the trough. Thus, only relatively small quantities of bath are required in the trough. This is not merely of interest from an economic viewpoint, but can also minimize environmental pollution.

Stripping means that have a roller arrangement comprising at least two rollers disposed on a support are preferably connected downstream of the deflection roller. The support is rotatable about an axis running parallel to the transverse direction of the continuous textile web. By changing the rotation angle of the stripping means, i.e., by selectively rotating the stripping means support about its axis, the specific surface pressure on the textile web can be increased or decreased. The textile web can thereby be more or less strongly stripped as a function of the rotation angle of the stripping means support. This is of particular interest if subsequent treatment steps, such as steaming, must be done with a prespecified bath load on the textile web, such as, for example, a load corresponding to from 100% to 150% of the weight of the textile web. Although such stripping means, in particular in combination with the trough, can be used with a bath distribution device having a changeable bath level height, the stripping means can also be used in combination with other bath distribution devices. The stripping means safely removes excess bath. The continuous textile web must merely be guided around the stripping means roller arrangement in such a fashion that, for example, rotating the stripping means support lengthens the path of the textile web. When that is done, the winding angle around each of the rollers is correspondingly increased, resulting in both an increased textile web tension and a larger pressure surface, i.e., a larger contact surface with the stripping means rollers. This is accomplished in a particularly simple manner when the roller arrangement has two rollers that are disposed along one diameter line of the stripping means support. The rollers are arranged to be in contact with opposite sides of the textile web. Such a design is known from so-called variable-tension rollers.

It is preferable for the rollers to be provided with braking means. If the rollers are not permitted to rotate freely, but instead are slowed by the braking means, then stripping can be further influenced. If the rollers are in fact slowed by the brakes, rope friction increases. Increased rope friction also contributes to removal of bath from the textile web.

The stripping means are connected to control means that adjust the rotation angle of the stripping means support and/or a braking moment of the stripping means roller brakes. Adjustment by the control means of the rotation angle or the braking moment is a function of stored values related to the continuous textile web. Such control means can, for example, be provided by using a microprocessor. To avoid the need to specify new values for every new production process, values that have been determined empirically or otherwise and that have proven their worth for certain types of textile web may be stored in a memory. When treating the corresponding textile web, one need only indicate the type of textile web concerned. The control means then automatically selects the correct values for the rotation angle or the braking moment.

It is highly advantageous for moisture measuring means, which are linked to the control means, to be connected downstream from the stripping means to measure the moisture level of the textile web. The rotation angle and/or braking moment can then be adjusted accordingly to achieve specific moisture values. The moisture measuring means determine the actual bath load applied to the textile web. The control means compare the determined actual bath load with a target bath load value that is prespecified for the specific textile web being treated. If there is a deviation from the target bath load value, the rotation angle of the support and/or the braking moment is changed so that the desired bath loading of the textile web is achieved.

The stripping means are advantageously disposed above the axis of the deflection roller and offset laterally from the deflection roller. This arrangement results in, on the one hand, the largest possible winding angle around the deflection roller, and, on the other hand, allows the stripped-off bath to flow almost directly back into the trough, so that there is little risk of losing or misdirecting the bath.

An equalization zone having multiple idler rollers is advantageously disposed after the deflection roller in the feed direction of the endless textile web, and a collection tray is allocated to each idler roller beginning at least with the second idler roller. The subsequent equalization zone is advantageous, particularly in connection with the addition distribution process, because the bath distributed on the textile web is provided with a suitable amount of time to penetrate into the textile web and to spread uniformly therein. The idler rollers help to "massage" the bath into the textile web. Collection trays or drainage sheets are disposed beneath the idler rollers, thus permitting the bath that is removed from the textile web at this stage to be readily collected and optionally returned to the bath application process. In particular, feeding the textile web from the bottom of the device toward the top of the device through the equalization zone while collecting removed bath liquid from the textile web prevents the removed bath from draining onto sections of the textile web that are in a lower position in the device.

The equalization zone is advantageously designed to function as an unheated section. Therefore, the endless textile web passing through the equalization zone is exposed to an ambient temperature instead of a higher temperature, such as, for example, a temperature sufficiently high to effect a change or a curing of the bath liquid. Because the bath recovered from the equalization zone has not been affected by the ambient temperature in the equalization zone, the recovered bath can be reused in the bath application process.

A levelling container is connected to the trough by communicating tubes. The levelling container is advantageously disposed adjacent to the trough and substantially corresponds in height to the trough. Since it is difficult to determine the liquid level height in the trough with the necessary accuracy, particularly when the trough surrounds the deflection roller to form a relatively small gap of for example, 10 mm., level height measuring means are disposed in the adjacent levelling container. When a levelling container is disposed next to the trough and connected to the trough by way of communicating tubes, located, for example, between the respective lowest points of the trough and the levelling container, then the bath height in the levelling container will correspond to the bath height in the trough. Thus, a level height measuring device, such as, for example, a float, can readily be disposed in the levelling container in order to determine the bath level height in the trough, which substantially corresponds to the liquid level height in the trough levelling container.

The levelling container is connected through a supply line to a reserve bath container, the supply line discharging a supply of bath into the levelling container in the area of the lowest level height in the container. When treating the continuous textile web, i.e., when applying the bath to it, the textile web leaving the trough continuously carries a portion of the bath away, which portion of the bath must be replenished in order to maintain the desired bath level height. A controllable throttle can, for example, be installed in the supply line so that reserve bath is supplied to the levelling container in a quantity equal to the quantity of the portion of the bath which is carried away from the trough by the treated textile web. Because the supply line discharges into the levelling container in the area of the lowest liquid bath level height, the supplied bath does not contribute to a disruption in measuring the bath level height in the levelling container, or the corresponding height in the trough.

A pump is disposed between the levelling container and the auxiliary bath supply means. It can be used to transfer bath by pumping to the auxiliary bath supply means. Bath that is returned from the equalization zone and elsewhere in the device is always automatically mixed with the freshly-added bath from the reserve bath container, so that a homogeneous bath is available that has substantially the same treatment result for the entire duration of treatment.

The objective of the invention is also fulfilled by a process of the type mentioned above in that the level height in the trough is changed to change the treatment time.

As mentioned above in connection with the device of the invention, a high bath level produces a long treatment time and a low bath level produces a short treatment time, without a complex conversion of the device and without having to change other process parameters, such as, for example, the feed speed of the textile web. For example, it is possible to change over from an addition distribution to a penetration distribution or vice versa. Thus, by either addition distribution or penetration distribution, maximum distribution of the bath can be freely selected without difficulty. In fact, substantially effortless transitions are possible.

In a particularly preferred embodiment, the bath level height can be changed during passage of the continuous textile web. This is particularly advantageous when continuous treatment must be achieved on a fabric batch, but different types of fabric succeed each other. In the present invention, the bath level height may be adjusted as a function of the type of textile web that requires treatment, thereby controlling the maximum distribution of the bath.

The bath level height for a particular treatment may be controlled as a function of a moisture content measurement of the textile web. By doing so, the bath distribution can be kept constant while the production speed remains unchanged, independent of the type of fabric or the fabric design. The bath uptake of the textile web is determined by the density of the fabric and the kind of fibers used. Some synthetic fibers have a low degree of bath uptake. To ensure that the bath is uniformly applied to the textile web, it was previously necessary to raise or lower the speed of travel of the textile web, a change which could negatively affect processing in other treatment zones. With the process proposed in the present invention, it is possible to control the bath distribution simply by changing the bath level height, which in turn produces the desired moisture content measurement in the textile web.

BRIEF DESCRIPTION OF THE DRAWINGS

The invention is described below with reference to a preferred embodiment in connection with the Figures, in which.

DESCRIPTION OF THE PREFERRED EMBODIMENT

Figures 1, 2, 3:
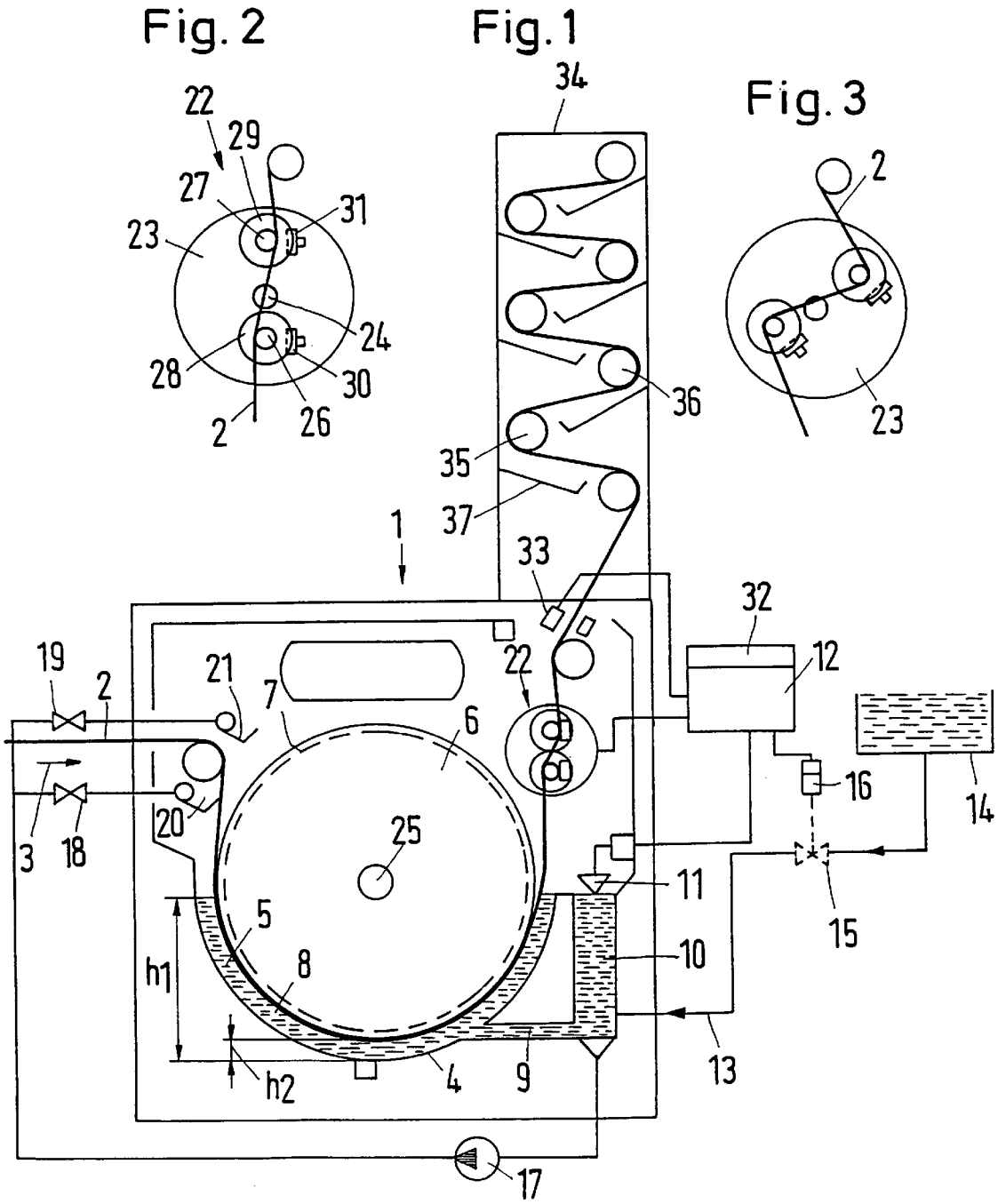
FIG. 1 shows a schematic drawing of a distribution device.
FIG. 2 shows stripping means in a first operating position.
FIG. 3 shows the stripping means in a second operating position.

As shown in FIG. 1, device 1 for continuous application of a bath 5, such as, for example, a peroxide bleach bath, to a continuous textile web 2, which passes through the device in the direction of arrow 3, has a trough 4, which is filled with bath 5. A deflection roller 6, which in the present case is designed as a baffle drum, dips into trough 4. Grooves provided in the baffle drum 6 are represented by a broken line 7. Textile web 2 is in contact with deflection roller 6. However, clearances are provided at least partially between deflection roller 6 and textile web 2 through which bath 5 is made available to the side of the textile web 2 that is in contact with deflection roller 6.

Trough 4 surrounds deflection roller 6 at a slight distance, thereby forming a gap 8 having a thickness of a few millimeters, such as, for example, 10 mm. The relatively narrow gap minimizes the bath content of the trough.

Trough 4 is connected by means of a line or tube 9 to a levelling container 10 in such a fashion that trough 4 and levelling container 10 together form a system of communicating containers.

A float 11, or other liquid level height measuring means is disposed in levelling container 10. The float or measuring means continuously communicates, to control means 12, the liquid level in levelling container 10 and therefore the corresponding liquid level in trough 4. Levelling container 10 is connected through a supply line 13 to a reserve container 14. A throttle 15 is disposed in supply line 13 and is selectively adjusted by adjustment means 16. Adjustment means 16 are connected to control means 12. Control means 12 can therefore influence the amount of liquid flowing through supply line 13.

A pump 17 is connected at the lowest point of levelling container 10. The pump 17 is optionally connected through throttles 18, 19 to auxiliary bath supply means in the form of spray nozzles 20, 21, or some other means of supplying liquid bath to textile web 2. The spray nozzles 20, 21 are disposed on opposite sides of textile web 2 and, therefore, bath 5 can be applied to both sides of textile web 2.

Stripping means 22, explained in greater detail with reference to FIGS. 2 and 3, are disposed in the feed path of the textile web after trough 4 in the direction of feed of the textile web. Stripping means 22 have a support 23, which is rotatable about an axis 24 that runs parallel to the transverse direction of textile web 2. In other words, axis 24 of support 23 is parallel to an axis 25 of deflection roller 6. Axis 24 is formed by shaft ends outside of the textile web.

Rollers 26, 27 are disposed on support 23, over which rollers the textile web is laid in an "S" shaped path, so that one side of textile web 2 is in contact with one roller 26 and the other side of textile web 2 is in contact with the other roller 27. Each roller 26, 27 is also provided with a brake disk 28, 29. Each brake disk 28, 29 is acted upon respectively by a brake 30, 31. By applying brakes 30, 31, a braking moment can be exercised on rollers 26, 27 through brake disks 28, 29. Under the influence of this braking moment rollers 26, 27 exercise a corresponding frictional force in the form of rope friction against textile web 2.

The degree of rotation of support 23 with respect to the device is referred to herein as the rotation angle. The rotation angle of support 23 with respect to the device can be selectively varied to alter the tension in textile web 2. For example, when support 23 is rotated in the clockwise direction to change the rotation angle, as shown in FIG. 3, the length of the path of the textile web increases, thereby increasing the tension in textile web 2. Conversely, the rotation angle of support 23 can be selectively varied by rotating the support 23 counterclockwise to decrease tension in textile web 2. Changing the tension in textile web 2 correspondingly changes the pressure exerted by the textile web 2 on the surfaces which the web 2 contacts, i.e., the surface pressure. Thus, selectively varying the rotation angle of support 23 changes the surface pressure. Changing the braking moment applied to the rollers 26, 27 changes the rope friction exerted by the rollers 26, 27 against the free movement of the textile web over the rollers 26, 27. In each case, the tension in textile web 2 is changed. The greater the tension, the more bath is stripped out of textile web 2. However, the stripping is done relatively gently.

The rotation angle of support 23 and the braking moment of brakes 30, 31 are controlled by control means 12. Control means 12 may have a memory 32 in which empirically determined values for certain types of textile webs are stored, thus avoiding the need to make time-consuming adjustments for each product change.

An equalization zone 34 is connected downstream of the moisture meter. The equalization zone 34 is comprised of multiple idler rollers 35, 36 that are arranged in two adjacent, spaced apart, vertical rows such that the idler rollers 35, 36 are vertically offset. The textile web passes over the vertically offset idler rollers 35, 36 in a zig-zag path. Thus, the idler rollers 35, 36 are suitably positioned to "massage" the applied bath on the surface of the textile web into the textile web and distribute it uniformly therein. Excess bath maybe squeezed out of the textile web and allowed to drain off. Collection trays 37 or drainage sheets are provided to capture and recover the excess bath. In a manner that is not shown in greater detail, the excess bath that is collected, i.e., the recovered bath, may be returned to levelling container 10 to be reused in the bath application process. Return of the recovered bath to the bath application is particularly possible if equalization zone 34 is maintained at an ambient temperature, i.e., the equalization zone is not heated. Preferably, heat is not provided to the textile web 2 until the web 2 reaches a steamer (not shown) in a processing step subsequent to the equalization zone, i.e., downstream from the equalization zone.

A moisture meter 33 is linked to control means 12 and is connected downstream from stripping means 22. Moisture meter 33 determines the actual value of loading of textile web 2 with bath 5. Control means 12 compare whether the actual value of bath loading corresponds to a target value. If the actual value of bath loading is not substantially the same as the target value of bath loading, control means 12 adjust the rotation angle of support 23 and/or the braking moment of brakes 30, 31, in order to bring the actual value of bath loading that has been determined by the moisture meter 33 into line with the target value of bath loading. Moisture meter 33 preferably may also be disposed after equalization zone 34 relative to the direction of feed of the textile web. Alternatively, a moisture meter (not shown) may also be disposed before the stripping means relative to the direction of feed of the textile web. The moisture meter (not shown) disposed before the stripping means measures the degree of loading of textile web 2 with bath 5 just after passing through trough 4. To obtain a desired moisture content of textile web 2 as expediently as possible, the bath level in the trough 4 may be adjusted up or down as a function of the actual moisture of textile web 2 as measured just after the web 2 has passed through trough 4.

The bath that drains from stripping means 22 also returns to levelling container 10 or to trough 4. To facilitate the return of excess bath liquid from stripping means 22, stripping means 22 are disposed above the axis 25 of deflection roller 6, but laterally adjacent to deflection roller 6, so that the excess bath draining from stripping means 22 does not drain back onto deflection roller 6, but instead returns directly to levelling container 10 or trough 4.

Pump 17 and throttles 18, 19 can be connected to control means 12 by way of connections that are not shown. Said control means 12 may control the circulation of the bath. Bath 5 is continuously carried away from the trough as a result of the loading of textile web 2 with bath 5, which loading can range for example from 100% to 150% loading based on the weight of the textile web. By suitably controlling throttle 15, and thereby controlling the supply of bath liquid from the reservoir container 14 to the trough 4 by way of the leveling container 10, a desired bath level may be maintained in trough 4. The bath level can be changed between a height $h_1$ (maximum level) and a height $h_2$ (minimum level). In the preferred embodiment, textile web 2 winds around approximately 180° of the circumference of deflection roller 6. Thus, at maximum level height $h_1$ the bath also substantially covers 180° of the circumference of the deflection roller 6. For example, a deflection roller 6 having a radius of 300 mm yields a treatment section, i.e. the section of the web in contact with the bath, length of approximately 940 mm. when the bath level is at the maximum level height $h_1$, i.e., 300 mm. Conversely, if the bath level height is lowered to minimum height $h_2$, during which only the lowest vertex of deflection roller 6 and therefore textile web 2 dips into bath 5, the resulting treatment section length for a deflection roller 6 having a radius, for example, of 300 mm is only 350 mm. The treatment section can be infinitely varied within the length range of from 350 mm to 940 mm. This treatment section length range allows addition distribution up to the bath carrying capacity of the textile, as well as penetration distribution with bath exchange rates of from 60% up to practically 100%. The distribution method for a particular textile can thus be selected as a function of the textile structure and process production speed. Furthermore, depending on the results desired, the advantages of each distribution method can be exploited.

It will naturally not be possible to lower the bath level by the entire radius of deflection roller 6, because textile web 2 is then no longer guaranteed to contact the bath 5. With the deflection roller 6 having, for example, an assumed radius of 300 mm, it is possible to make a 280 mm reduction in bath level, i.e., a reduction of over 90% of the radius of the deflection roller 6. At this low level the treatment section of the textile web, i.e., the section of the textile web in contact with the bath is drastically reduced relative to a treatment section in a bath at the highest bath level. Due to the low bath content of the trough and a rapid continuous replacement of the bath, such as, for example, a peroxide bleach bath, cooling of the feeding textile web is unnecessary. For example, during an addition distribution process a temperature increase in trough 4 is not a concern. Therefore, the bath may be applied up to the maximum carrying capacity of the textile without concerns about contamination of the treatment bath by liquid that is already contained in the textile web from an earlier process step, because the textile is not penetrated by the bath until the textile is "massaged" in the subsequent ambient temperature equalization zone 34.

Modifications and variations of the invention as set forth herein can be made without departing from the spirit and scope of the invention as defined in the appended claims.

What is claimed is:

1. An apparatus for applying a bath to a continuous textile web, the apparatus comprising:

a trough for containing the bath;

a deflection roller, said deflection roller at least partially disposed in said trough, said deflection roller contacting the textile web as the textile web passes through the trough; and means for adjusting a treatment time of the textile web, the treatment time being a period of time in which the textile web is in contact with the bath in said trough, said treatment time adjustment means controlling a level of the bath in said trough such that the level of the bath can be changed by a height corresponding to the winding height of the deflection roller, the winding height being the difference in height between the lowest point of the web in contact with the bath and the highest point of the web in contact with said deflection roller.

2. The apparatus according to with claim 1, wherein said deflection roller has a circumference, and the textile web winds around as much as 180° of said circumference of said deflection roller.

3. The apparatus according to claim 2, wherein the trough has a cross section which closely approximates a lower half of the circumference of the deflection roller, such that said trough surrounds a lower half of the deflection roller in a spaced apart relationship to form a gap.

4. The apparatus according to claim 1, wherein said deflection roller is a baffle drum.

5. The apparatus according to claim 1, further comprising auxiliary bath supply means disposed to provide the bath on at least a first side of the textile web.

6. The apparatus according to claim 1, further comprising stripping means having a roller arrangement comprising at least two rollers, said rollers disposed on a support, said stripping means provided in a feed path of the textile web, said stripping means provided after said deflection roller in a feed direction of the textile web, and said support rotatable about an axis, said support axis being oriented transversely to the feed direction of the textile web and parallel to the surface of the textile web.

7. The apparatus according to claim 6, wherein the stripping means rollers are provided with braking means.

8. The apparatus according to claim 7, further comprising control means, said control means controlling a braking moment of said braking means.

9. The apparatus according to claim 8 wherein said braking moment is determined as a function of a predetermined value related to the textile web.

10. The apparatus according to claim 6, further comprising control means, said control means controlling a rotation angle of said stripping means support.

11. The apparatus according to claim 10 wherein said rotation angle is determined as a function of a predetermined value related to the endless textile web.

12. The apparatus according to claim 10, further comprising moisture measuring means connected to said control means, said moisture measuring means measuring a moisture content of said textile web at a point in said process.

13. The apparatus according to claim 6, wherein said stripping means are disposed above an axis of said deflection roller and said stripping means are offset laterally from said deflection roller.

14. The apparatus according to claim 1, further comprising an equalization zone disposed in a feed path of the textile web, said equalization zone disposed after said deflection roller in a feed direction of the textile web, said equalization zone having multiple idler rollers.

15. The apparatus according to claim 14 further comprising a collection tray positioned under at least one of said idler rollers.

16. The apparatus according to claim 14 further comprising a collection tray positioned under each of said idler rollers, beginning at least with the second idler roller.

17. The apparatus according to claim 14, wherein the equalization zone is unheated.

18. The apparatus according to claim 1 further comprising a levelling container disposed adjacent to the trough, said levelling container being in fluid communication with said trough.

19. The apparatus according to claim 18 further comprising a bath level height measuring means disposed in said levelling container.

20. The apparatus according to claim 18, further comprising:

a reserve bath container;

a supply line; and wherein said levelling container is connected through said supply line to said reserve bath container, said supply line discharging into said levelling container in an area of lowest bath level height.

21. The apparatus according to claim 18 further comprising:

auxiliary bath supply means disposed to provide bath on at least a first side of the textile web;

a pump disposed between said levelling container and said auxiliary bath supply means.

22. A process for application of a bath to a continuous textile web, which process comprises:

guiding the textile web through a trough containing the bath, changing the bath level height in the trough to control the treatment time of the textile web in the bath, wherein the bath level height is controlled as a function of a moisture measurement of the endless textile web.

23. The process in accordance with claim 22, wherein the bath level height is changed during passage of the endless textile web.

24. An apparatus for applying a bath to a continuous textile web, the apparatus comprising:

a trough for containing the bath;

a deflection roller, said deflection roller at least partially disposed in said trough, said deflection roller contacting the textile web as the textile web passes through the trough;

means for adjusting a treatment time of the textile web, the treatment time being a period of time in which the textile web is in contact with the bath in said trough, said treatment time adjustment means controlling a level of the bath in said trough; and stripping means having a roller arrangement comprising at least two rollers, said rollers disposed on a support, said stripping means provided in a feed path of the textile web, said stripping means provided after said deflection roller in a feed direction of the textile web, and said support rotatable about an axis, said support axis being oriented transversely to the feed direction of the textile web and parallel to the surface of the textile web, said stripping means rollers being provided with braking means.

25. An apparatus for applying a bath to a continuous textile web, the apparatus comprising:

a trough for containing the bath;

a deflection roller, said deflection roller at least partially disposed in said trough, said deflection roller contacting the textile web as the textile web passes through the trough;

means for adjusting a treatment time of the textile web, the treatment time being a period of time in which the textile web is in contact with the bath in said trough, said treatment time adjustment means controlling a level of the bath in said trough;

stripping means having a roller arrangement comprising at least two rollers, said rollers disposed on a support, said stripping means provided in a feed path of the textile web, said stripping means provided after said deflection roller in a feed direction of the textile web, and said support rotatable about an axis, said support axis being oriented transversely to the feed direction of the textile web and parallel to the surface of the textile web; and control means, said control means controlling a rotation angle of said stripping means support.

26. An apparatus for applying a bath to a continuous textile web, the apparatus comprising:

a trough for containing the bath;

a deflection roller, said deflection roller at least partially disposed in said trough, said deflection roller contacting the textile web as the textile web passes through the trough;

means for adjusting a treatment time of the textile web, the treatment time being a period of time in which the textile web is in contact with the bath in said trough, said treatment time adjustment means controlling a level of the bath in said trough;

stripping means having a roller arrangement comprising at least two rollers, said rollers disposed on a support, said stripping means provided in a feed path of the textile web, said stripping means provided after said deflection roller in a feed direction of the textile web, and said support rotatable about an axis, said support axis being oriented transversely to the feed direction of the textile web and parallel to the surface of the textile web, said stripping means being disposed above an axis of said deflection roller, and said stripping means being offset laterally from said deflection roller.

27. An apparatus for applying a bath to a continuous textile web, the apparatus comprising:

a trough for containing the bath;

a deflection roller, said deflection roller at least partially disposed in said trough, said deflection roller contacting the textile web as the textile web passes through the trough;

means for adjusting a treatment time of the textile web, the treatment time being a period of time in which the textile web is in contact with the bath in said trough, said treatment time adjustment means controlling a level of the bath in said trough;

a levelling container disposed adjacent to the trough, said levelling container being in fluid communication with said trough;

a reserve bath container; and a supply line; and wherein said levelling container is connected through said supply line to said reserve bath container, said supply line discharging into said levelling container in an area of lowest bath level height.

28. An apparatus for applying a bath to a continuous textile web, the apparatus comprising:

a trough for containing the bath;

a deflection roller, said deflection roller at least partially disposed in said trough, said deflection roller contacting the textile web as the textile web passes through the trough;

means for adjusting a treatment time of the textile web, the treatment time being a period of time in which the textile web is in contact with the bath in said trough, said treatment time adjustment means controlling a level of the bath in said trough; and stripping means having a roller arrangement comprising at least two rollers, said rollers disposed on a support, said stripping means provided in a feed path of the textile web, said stripping means provided after said deflection roller in a feed direction of the textile web, and said support rotatable about an axis, said support axis being oriented transversely to the feed direction of the textile web and parallel to the surface of the textile web.

29. An apparatus for applying a bath to a continuous textile web, the apparatus comprising:

a trough for containing the bath;

a baffle drum, said baffle drum at least partially disposed in said trough, said baffle drum contacting the textile web as the textile web passes through the trough; and means for adjusting a treatment time of the textile web, the treatment time being a period of time in which the textile web is in contact with the bath in said trough, said treatment time adjustment means controlling a level of the bath in said trough.

* * * * *